US006354892B1

(12) United States Patent
Staerzl

(10) Patent No.: US 6,354,892 B1
(45) Date of Patent: Mar. 12, 2002

(54) SAFETY DEVICE FOR A MARINE VESSEL

(75) Inventor: Richard E. Staerzl, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/808,298

(22) Filed: Mar. 14, 2001

(51) Int. Cl.[7] ..... B63H 21/22
(52) U.S. Cl. ..... 440/1
(58) Field of Search ..... 440/1, 84; 114/151, 114/362

(56) References Cited

U.S. PATENT DOCUMENTS

| | | | | |
|---|---|---|---|---|
| 3,805,723 A | * | 4/1974 | Bernaerts | 440/1 |
| 3,936,822 A | | 2/1976 | Hirschberg | 340/420 |
| 3,950,645 A | | 4/1976 | Rotstein et al. | 250/352 |
| 4,941,854 A | * | 7/1990 | Takahashi et al. | 440/1 |
| 5,018,872 A | | 5/1991 | Suszynski et al. | 374/133 |
| 5,283,427 A | | 2/1994 | Phillips et al. | 250/214 |
| 5,987,205 A | | 11/1999 | Moseley et al. | 385/125 |
| 6,100,803 A | | 8/2000 | Chang | 340/567 |
| 6,142,841 A | | 11/2000 | Alexander, Jr. et al. | 440/38 |
| 6,160,948 A | | 12/2000 | McGaffigan | 385/901 |
| 6,276,974 B1 | * | 8/2001 | Bouge et al. | 440/1 |

OTHER PUBLICATIONS

Product Identification Sheet—Nippon Ceramic Co., Ltd.

* cited by examiner

*Primary Examiner*—Stephen Avila
(74) *Attorney, Agent, or Firm*—William D. Lanyi

(57) ABSTRACT

A safety for a marine vessel provides an infrared sensor with a tube having a central cavity in order to define a viewing angle which is more narrow than the inherent viewing angle of the infrared sensor. The central cavity of the tube also defines a line of sight that can be directed toward a particular region near a marine vessel that is to be monitored for the presence of a heat generating object, such as a human being. An alarm circuit is responsive to signals from the infrared sensor and deactivates the marine propulsion system when a heat generating object is near the marine propulsion system. The length and diameter of the tube are selected to provide a desired viewing angle for the infrared sensor. An audible alarm output is provided if an attempt is made to manipulate a joystick that controls the marine propulsion system when a heat generating object is sensed by the infrared sensor.

20 Claims, 3 Drawing Sheets

SAFETY DEVICE FOR A MARINE VESSEL

BACKGROUND OF THE INVENTION

1. Field of the Invention

The present invention is generally related to a safety device for a marine vessel and, more particularly, to a detector that senses the presence of a human being in the region of the marine propulsion device and deactivates the device to prevent injury to the human being.

2. Description of the Prior Art

Many different types of marine propulsion devices are well known to those skilled in the art. For example, outboard motors that are attached to the transom of a marine vessel, stern drive systems that extend in a rearward direction from the transom of a marine vessel, docking thrusters, and bow thrusters are well known to those skilled in the art. In addition to bow thrusters, certain types of docking thruster systems used in conjunction with marine vessels incorporate a plurality of propulsors that are responsive to the joystick manipulations of a marine vessel operator.

Many types of infrared sensors are well known to those skilled in the art. These types of sensors have been used in many applications where the presence of a human being is detected and the detection is used to activate or deactivate a device, such as a lighting system.

U.S. Pat. No. 6,142,841, which issued to Alexander et al on Nov. 7, 2000, discloses a water jet docking control system for a marine vessel. Several versions of the docking system are disclosed in this patent. Once system utilizes pressurized liquid at three or more positions of a marine vessel in order to selectively create thrust that moves the marine vessel into desired locations and according to chosen movements. Electrical embodiments of the system utilize one or more pairs of impellers to cause fluid to flow through the outlet conduits in order to provide thrust on the marine vessel. In one embodiment of the device, a cross thrust conduit is associated with the marine vessel to direct fluid flow in a direction perpendicular to a centerline of the marine vessel and a pair of outlet conduits are associated with the marine vessel to direct flows of fluid in directions which are neither parallel nor perpendicular to a centerline of the marine vessel.

U.S. Pat. No. 5,283,427, which issued to Phillips et al on Feb. 1, 1994, describes a night sight for a missile launcher comprising an image intensifier tube, a reticle, and an objective lens. The missile launcher night sight has an objective lens with a field of view of at least 22 degrees. The output image of the objective lens is intensified by a variable gain light intensifier tube and the output of the intensifier is viewed through an eyepiece. A reticle pattern etched on a glass substrate and filled with titanium dioxide is illuminated by adjustable brightness LED's positioned at points on the periphery of the substrate. The reticle is disposed between the light intensifier and the eyepiece and substantially duplicates the function of reticles used in daysights.

U.S. Pat. No. 6,160,948, which issued to McGaffigan on Dec. 12, 2000, describes optical light pipes with laser light appearance. A simulated laser light system includes a light source which emits substantially parallel light rays and a prismatic element having a plurality of prismatic surfaces. The prismatic surfaces define a curved surface either on the inside or the outside of the prismatic element. The prismatic surfaces redirect the light rays emitted from the prismatic element in a plurality of plants which are perpendicular to a tangent to the curved surface. The simulated laser light system appears to emit light from a centerline of the prismatic element when the light is actually emitted from an exterior surface of the prismatic element.

U.S. Pat. No. 3,950,645, which issued to Rotstein et al on Apr. 13, 1976, describes an infrared detection tube. An imaging device comprises a cooling means for lowering the temperature of the device, a wafer of preselected infrared sensitive material, a layer of thin infrared transparent electrically conductive material deposited on one side of the wafer, a wire mosaic, the wire mosaic being in intimate contact with the remaining side of the wafer, opaque material filling a preselected area between the wires of the wire mosaic, and a silver paste interposed between the wafer and the tips of the wires of the wire mosaic. The resistance of the infrared sensitive wafer cooperates with a grid current flow and reduces the bias permitting flow of electrons according to infrared radiation impinging on the wafer.

U.S. Pat. No. 3,936,822, which issued to Hirschberg on Feb. 3, 1976, describes a method and apparatus for detecting weapon fire. The method and apparatus disclosed in this patent relates to the automatic detection of the firing of weapons, such as small arms, or the like. Radiant and acoustic energy produced upon occurrence of the firing of the weapon and emanating from the muzzle thereof are detected at known, substantially fixed, distances therefore. Directionally sensitive radiant and acoustic energy transducer means are directed toward the muzzle to receive the radiation and acoustic pressure waves therefrom may be located adjacent each other for convenience.

U.S. Pat. No. 5,018,872, which issued to Suszynski et al on May 28, 1991, describes a probe assembly for an infrared thermometer. The probe assembly is adapted for insertion into a patient's ear canal and facilitates a rapid measurement of the patient's body temperature with very high accuracy. The probe assembly includes a plastic outer tube sized to fit snugly in the patient's ear canal, with an elongated heat sink and an infrared sensor located within the tube.

U.S. Patent No. 6,100,803, which issued to Chang on Aug. 8, 2000, describes an infrared illuminative warning detector. The detector includes a base seat formed with at least four perforations for two light shades and two detector heads to insert in. A bulb in installed in each light shade. An infrared detector is disposed in each detector head for detecting alien article within a detection range and lighting up the bulb. Each light shade and detector head is disposed with at least one shifting mechanism for freely changing operation position. The light shades and the detector heads on the base seat are able to detect in different directions at the same time to provide a warning and illumination function in the case of intrusion of alien article.

U.S. Pat. No. 5,987,205, which issued to Moseley et al on Nov. 16, 1999, describes an infrared energy transmissive member and radiation receiver. The infrared energy transmissive member is used for conducing infrared energy from a first end of the infrared energy transmissive member to a second end disposed adjacent an infrared responsive circuit component of an infrared receiver. The member comprises a flexible hollow plastic tube. Preferably, the plastic tube comprises an ester based polyurethane tube and has a malleable rod disposed in the hollow plastic tube to allow the hollow plastic tube to be bent into a claimed configuration. The infrared responsive circuit component may control a fluorescent lamp dimming circuit or a window treatment control circuit, thereby allowing remote control of the lamp or window treatment.

The patents described above are hereby expressly incorporated by reference in the description of the present invention.

SUMMARY OF THE INVENTION

A safety device for a marine vessel, made in accordance with the present invention, comprises an electrical device, such as an electrical marine propulsion device, and an infrared sensor having an output signal representing a change in heat intensity within a viewing angle of the infrared sensor. It should be understood that the electrical device can be an electrically driven propulsor, such as a bow thruster for a marine vessel, or any other marine propulsion device that has an electrical element that can be deactivated for the purpose of deactivating the marine propulsion device. As an example, a conventional outboard motor incorporating an ignition system which is electrical is an electrical device within the meaning of the description of the present invention. The outboard motor can be deactivated, for example, by deactivating the ignition system.

The present invention further comprises a tube having a central cavity, the central cavity having a first end and a second end. The infrared sensor is disposed at the first end of the central cavity to receive infrared signals passing along a line of sight defined by the tube in a direction through the central cavity from the second end of the central cavity toward the first end. The viewing angle of the infrared sensor is defined by a length of the tube and a diameter of the tube. The tube is attached to the marine vessel to direct the line of sight in a generally downward direction toward a surface of water proximate the marine vessel to detect a change in heat intensity in a region proximate the surface of water and proximate the marine vessel. A preferred embodiment of the present invention further comprises an alarm circuit that is connected in signal communication with the infrared sensor and an electrical communication with the electrical device. The alarm circuit is configured to deactivate the electrical device in response to receipt of the output signal from the infrared sensor.

The magnitude of the length of the tube in a preferred embodiment of the present invention, is at least three times the magnitude of the diameter of the tube. More specifically, one embodiment of the present invention that has been empirically tested comprises a tube whose length is four times the magnitude of its diameter.

The alarm circuit can have an audible alarm output that is sounded in response to receipt of the output signal from the infrared sensor. The electrical device can be an electric motor with a propulsor attached to an output shaft of the electric motor or, as described above, it can be any marine propulsion device or system that incorporates an electric component that can be affected for the purpose of deactivating the electrical device.

In a particularly preferred embodiment of the present invention, the tube is opaque and the central cavity is circular in cross section. The infrared sensor in a preferred embodiment of the present invention comprises two infrared sensing elements that are associated with each other in a differential arrangement.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
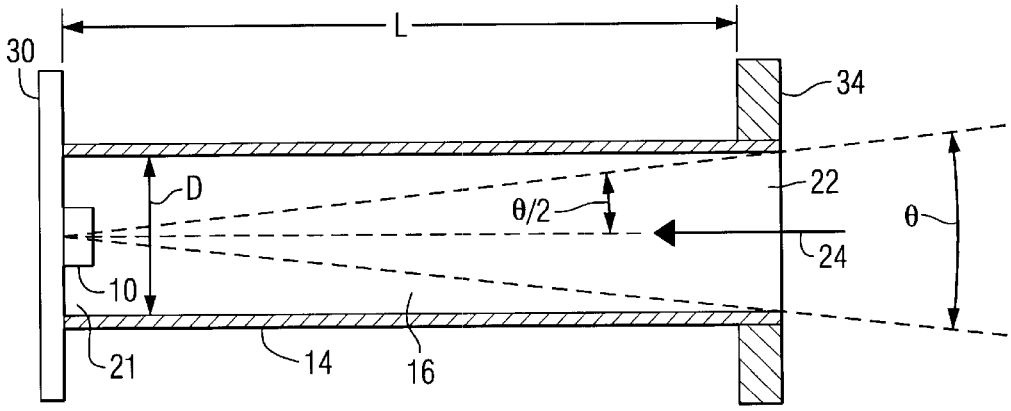
FIG. 1 is a section side view of a tube with an infrared sensor disposed at its end.

Throughout the description of the preferred embodiment of the present invention, like components will be identified by like reference numerals.

FIG. 1 shows an infrared sensor 10 which has an output signal that represents a changes in heat intensity within a viewing angle of the infrared sensor. A tube 14 is provided with a central cavity 16 that has a first end 21 and a second end 22. The infrared sensor 10 is disposed at the first end 21 of the central cavity 16 to receive infrared signals passing along a line of sight represented by arrow 24 in FIG. 1. The line of sight is defined by the tube 14 in a direction along the central cavity 16 from the second end 22 of the central cavity to the first end 21. The viewing angle θ of the infrared sensor 10 is defined by a length L of the tube and a diameter D of the tube. More precisely, the viewing angle θ is equal to twice the arc tangent of the radius of the tube 14 divided by the length L. In other words, the diameter D divided by two times the length L is the tangent of half of the viewing angle θ. As will be described in greater detail below, the tube 14 is intended to be attached to a marine vessel at a position which directs the line of sight 24 in a generally downward direction toward the surface of water proximate the marine vessel in order to detect changes in heat intensity in a region proximate the surface of the water and also proximate the marine vessel. The infrared sensor 10 is attached to a circuit board 30 which is, in turn, attached to the tube 14. At the second end 22 of the tube 14, a mounting plate 34 is attached to the tube to allow the device shown in FIG. 1 to be rigidly mounted to the structure of a marine vessel. If the cone of vision, defined by the viewing angle θ, is pointed in a downward direction toward the surface of water, changes in the heat intensity within the viewing angle θ will be detected by the infrared device 10 and an output signal will be provided by the infrared device 10 representing a change in heat intensity within the viewing angle.

Figure 2:
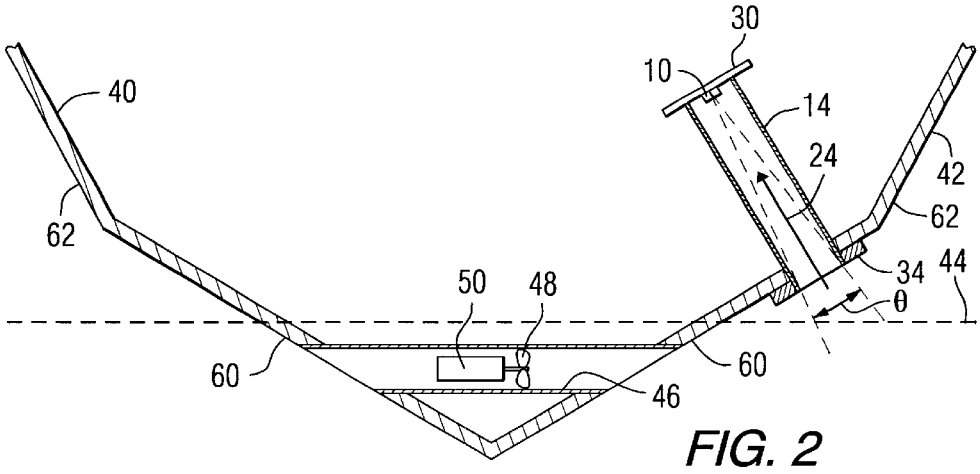
FIGS. 2, 3, and 4 show various views of a safety device attached to a hull of a marine vessel.

FIG. 2 is a simplified schematic representation of a marine vessel 40 with a hull 42. Dashed line 44 represents the surface of water in which the marine vessel 40 is being operated. Extending through the hull 42 of the marine vessel 40 is an exemplary bow thruster that comprises a tubular portion 46 with a propulsor 48 driven by an electric motor 50. In a manner generally known to those skilled in the art, the bow thruster causes water to flow either in the port or starboard direction through the tubular portion 46 in order to provide a force on the bow that assists in maneuvering the marine vessel 40, particularly during docking maneuvers. As can be seen in FIG. 2, the hull 42 is represented as having two relatively simple surfaces, 60 and 62, on each side of the marine vessel 40. Throughout the description of the preferred embodiment of the present invention, it should be clearly understood that the components are not drawn to scale. For example, in FIG. 2, the tube 14 is drawn larger in relation to the marine vessel 40 than it actually is. This is done of purposes of clarity in the description.

The mounting plate 34 is attached to hull surface 60 and the tube 14 extends inwardly into the marine vessel. The line of sight 24 is directed downward toward the surface of the water 44 in order to receive infrared signals in a generally upward direction from objects in the water proximate the marine vessel 40 and also proximate the propulsion device within the tubular portion 46 of the bow thruster. The viewing angle θ, which is defined by the length and diameter of the tube 14, is narrowed by the relative magnitudes of the length and diameter of the tube 14 in order to focus the effective viewing angle θ toward a preselected location near the bow thruster or near another marine propulsion device. If the tube 14 was not provided for the infrared sensor 10, the viewing angle naturally occurring with infrared sensors would be much too wide and would be severely subjected to false triggering by reflections from the water surface 44.

Figure 3:
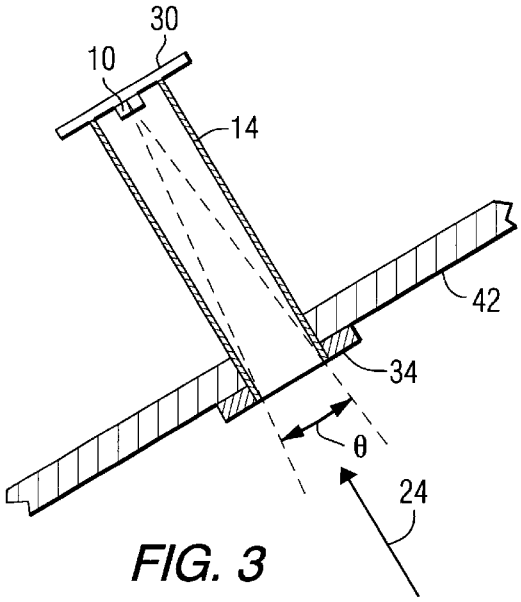

FIG. 3 is an isolated view of the present invention attached to the surface 60 of the hull 42 of the marine vessel 40 described above in conjunction with FIG. 2. The mounting plate 34 allows the device to be attached rigidly to the hull 42. It should be understood that the viewing angle θ can be decreased if necessary by providing either a smaller diameter D or a longer length L of the tube 14, as described above in FIG. 1. The selection of the length and diameter of the tube 14 will depend on the particular application of the present invention, but it has been determined empirically that a ratio of length to diameter of three or greater provides satisfactory results and a ratio of four has been determined to be particularly satisfactory for use in conjunction with a marine vessel 40 and a docking system similar to that described above and specifically illustrated in U.S. Pat. No. 6,142,841. The safety device is particularly effective when the line of sight 24 is directed downward toward the surface of water 44 near the opening of a tubular portion 46, or tunnel, of one of the propulsors used in the docking system described and illustrated in U.S. Pat. No. 6,142,841.

Figure 4:
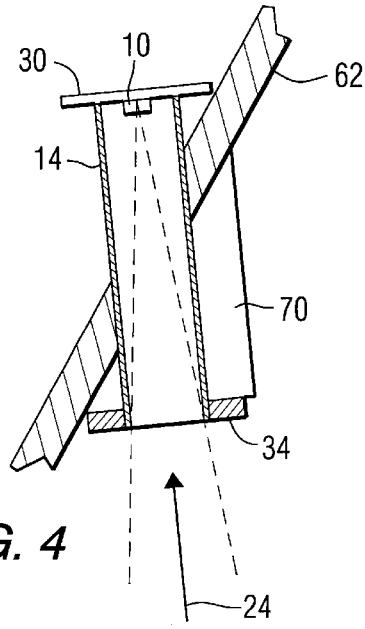

In FIG. 2, the hull 42 is shown with two surfaces, 60 and 62, that are at different angles to a vertical plane. The angles defined by a hull of a marine vessel 40 can vary significantly over a wide range of dimensions and angles to vertical. The particular hull surfaces, 60 and 62, described above in conjunction with FIG. 2 are merely intended to be representative of a wide range of such angles. FIG. 4 illustrates the application of the present invention in conjunction with hull surface 62. Because of the increased angle of hull surface 62 to a horizontal plane, in comparison to hull surface 60, a triangular block 70 is attached to the hull surface 62 in order to allow the line of sight 24 to be directed in a generally vertical angle toward the surface of water 44. Although not precisely vertical, the line of sight 24 in FIGS. 2, 3, and 4 all have a significant vertical component. This positioning of the tube 14 and its line of sight 24 allows the region near the surface of water and near the vessel 40 to be monitored for the presence of a heat generating object, such as a human being swimming near the boat and near the propulsion device. In certain applications, a sun shield or a reflector can be used to further improve the operation of the present invention.

The provision of the tube 14 in conjunction with the infrared sensor 10 allows the present invention to utilize a less expensive infrared sensor 10 than would otherwise be required if a narrow viewing angle is specified as a characteristic of the infrared sensor 10 itself. It also allows the sensitivity of the infrared sensor 10 to be tailored by the appropriate selection of tube length and diameter, L and D.

Figure 5:
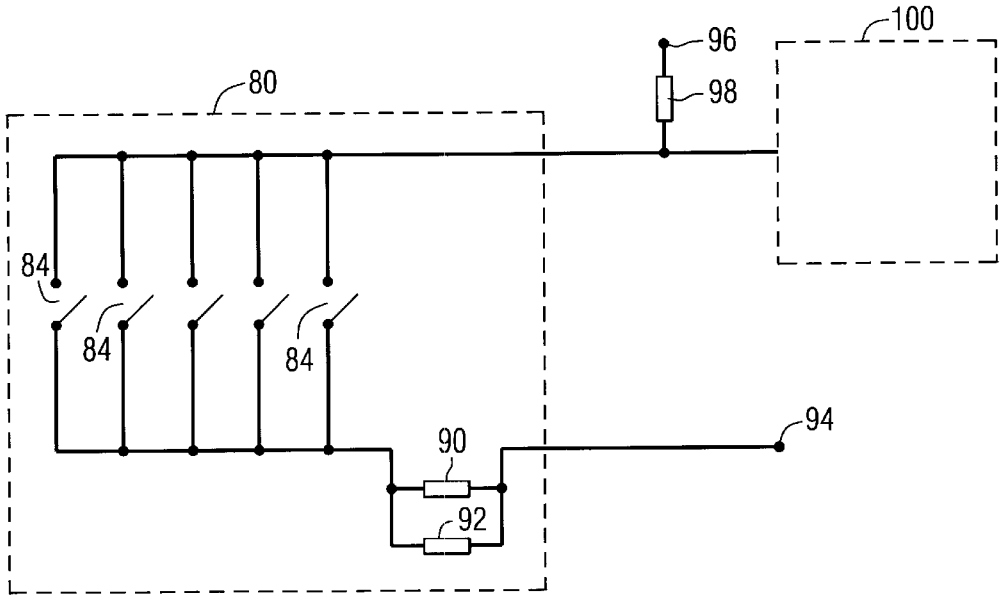
FIG. 5 is a highly schematic representation of a joystick circuit.

FIG. 5 is a simplified schematic representation of a joystick circuit 80 with a plurality of switches 84 associated with the various positions of the joystick. Although five switches 84 are illustrated in FIG. 5, is should be understood that many different joystick controllers incorporate greater numbers of switches to represent the various directional positions of the joystick. In addition, switches are often provided in joysticks to represent rotation of the joystick handle relative to its base or movement of the joystick handle into or out of the base. Component 90 is a 1k-OHM resistor and component 92 is a field effect transistor (FET). Circuit point 94 is a circuit ground, circuit point 96 is a 12 VDC supply, and component 98 is a 1k-OHM resistor. Dashed box 100 represents a circuit that implements commands from the joystick 80 and calculates appropriate energization levels of electric motors which drive individual propulsors. The implementation of the joystick commands to cause the various propulsors to be energized electrically is described in U.S. Pat. No. 6,142,841 and will not be discussed in detail herein. If any of the switches 84 are closed and the field effect transistor 92 is open, the system operates normally and the electric motors of the propulsion system 100 respond to the closure of switches 84 in order to implement the desires of the marine vessel operator as the joystick is manipulated.

Figure 6:
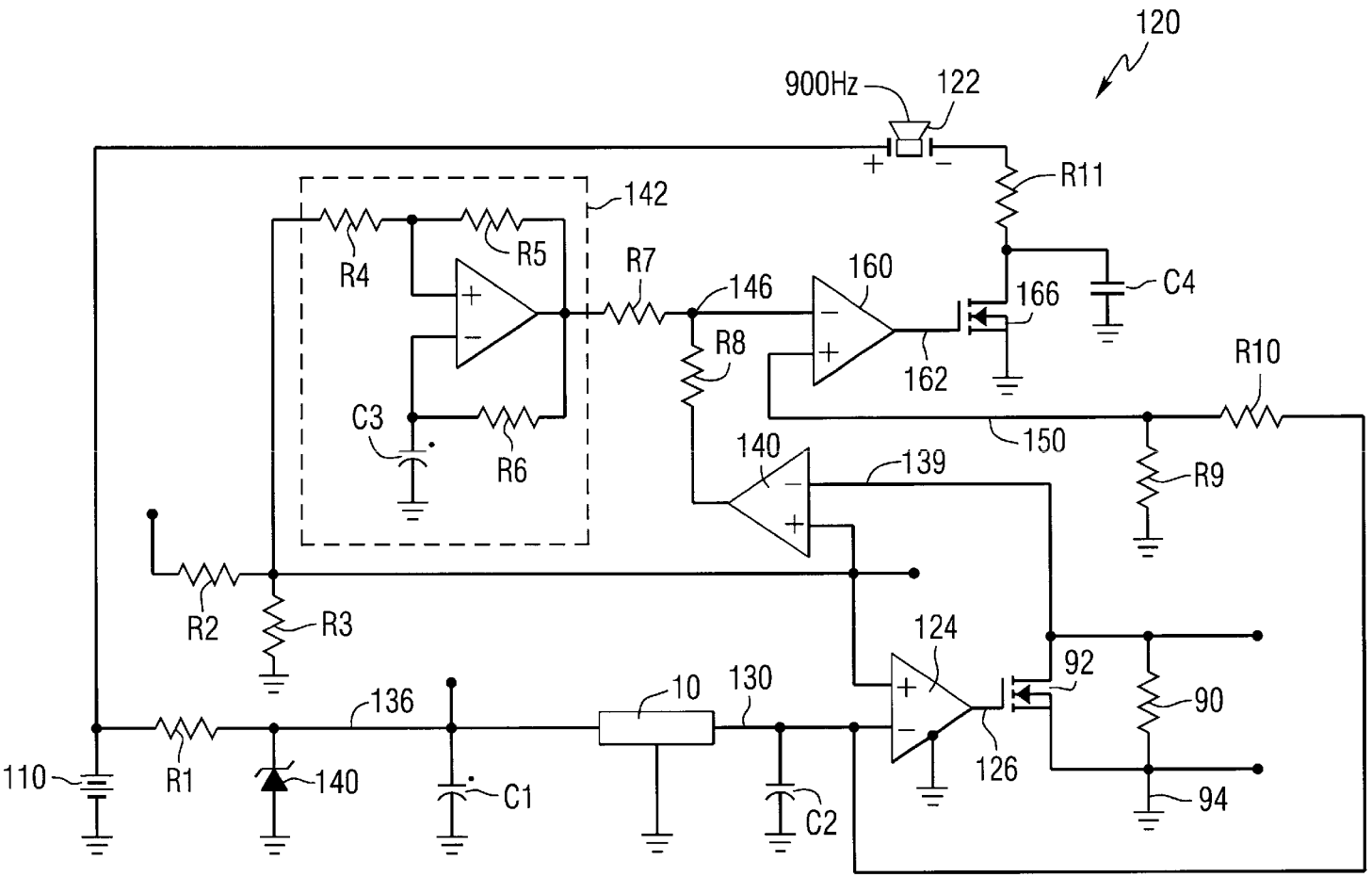
FIG. 6 shows an alarm circuit of the present invention.

With reference to FIG. 6, a combination with the illustration of FIG. 5, the alarm circuit 120 performs two important functions. First, it disables the activation of the marine propulsion system, such as a bow thruster or docking thruster, in response to receipt of the output signal from the infrared sensor and it provides an audible alarm by activating a device such as the 900 Hz component 122 shown in FIG. 6. With reference to FIGS. 5 and 6, the field effect transistor 92 and the 1 kΩ resistor 90 are common to both Figures. Similarly, the point of circuit ground 94 is also shown in both FIGS. 5 and 6. The infrared sensor 10 is connected to the inverting input of a comparator 124. If the output 126 of comparator 124 is low, the marine propulsion devices are deactivated because the signal from the infrared sensor 10 indicates that a person may be in the region of the marine propulsion system and could possibly be injured as a result of the continued operation of the marine propulsion system. In other words, a high signal from the infrared sensor 10, on line 130, disables the associated marine propulsion component, such as a bow thruster or docking thrusters. When the output signal is provided by the infrared sensor 10, on line 130, the voltage potential of line 130 is raised to 9.0 volts. A power supply 110, such as a battery, provides a voltage on line 136 which is generally equal to 9.1 volts because of the operation of the zener diode 140. The capacitor C1 acts as a filter to minimize spurious signals on line 136.

In response to a high signal on line 130 from the infrared sensor 10, the comparator 124 provides a low signal on line 126 and, as a result of the FET 92 being open and switch 84 being closed, the inverting input of comparator 140 is caused to be high (FET open). Dashed box 142 represents an oscillator that causes the output device 122 to emit an intermittent beeping sound in response to an alarm condition. The oscillator 142 provides a square wave signal at point 146 which varies in potential from 0 volts to 4 volts. When a hazard condition is sensed by the infrared sensor 10, the high signal on line 130 is transmitted on line 150 to the non-inverting input of comparator 160. The high signal on line 150 and at the non-inverting input of comparator 160 provides a high signal at line 162 and at the gate of field effect transistor 166. This provides a current path through resistor R11 and field effect transistor (FET) 166 which activates the audible device 122.

With reference to FIGS. 5 and 6, if the joystick is manipulated by the marine operator when a signal is being received from the infrared sensor 10, the signal level on line 139 will be raised to a high condition because of the direct connection between the voltage source at point 96 in FIG. 5 and line 139 in FIG. 6. This provides a low signal at point 146 which provides a high signal on line 162 at the output of comparator 160. This, in turn, activates the audible device 122. Because of the intermittent square wave provided by the oscillator 142, the sound emitted by device 122 will be intermittent, or beeping.

If a signal is provided by the infrared sensor 10, but no attempt is made to manipulate the joystick and activate the marine propulsion systems or their motors, line 126 at the output of comparator 124 will be low and line 139 will be low. As a result, the signal level at point 146 will be high and the output at line 162 at the output of comparator 160 will be low. As a result, no sound will be emitted from the device 122 but the motor of the thruster will be deactivated.

The operation of the present invention deactivates the marine propulsion systems in the event that a signal is provided by the infrared sensor 10 indicating that a human being or other heat producing object is in the vicinity of the marine propulsion unit. Under those conditions, the marine. propulsion system is deactivated, but no alarm is sounded if the joystick switches 84 are all open. If, however, any attempt it made to manipulate the joystick to cause the marine propulsion system to be activated, the present invention continues to prevent that activation of the marine propulsion system and, additionally, it sounds an intermittent beeping horn sound to warn the marine vessel operator that the attempt to manipulate the joystick is being prevented from activating the marine propulsion systems because of the presence of a heat producing object in the vicinity of the marine propulsion system.

It has been determined that if a standard infrared sensor is used for these purposes, without the beneficial inclusion of a tube 14, many false signals are provided at the output of the infrared sensor 10 because of the reflections from the water surface. These constantly changing reflections are likely to trigger false signals from the infrared sensor. By providing the tube 14 in the manner described above, the area of the monitored region from which infrared signals can be received by the infrared signal 10 is significantly limited to more accurately cover the area most proximate the marine propulsion system.

With reference to FIGS. 1–6, the ratio between the length L and diameter D of the tube determines the magnitude of the viewing angle θ and the position of the tube 14 relative to the marine vessel 40 determines the angle at which the line of sight 24 is directed from the marine vessel. A tube 14 with the longer length L or a smaller diameter D will have a reduced viewing angle θ. In certain cases, lengthening the tube 14 or providing a tube with a smaller diameter D will allow the system to more narrowly focus on a particular region near the marine propulsion system. The device illustrated in FIG. 1 can be mounted to the hull 42 of a marine vessel 40, as described above in conjunction with FIGS. 2, 3, and 4. An alarm circuit 120 is connected in signal communication with the infrared sensor 10 and in electrical communication with the electrical device, such as an electric motor of a bow thruster or other marine propulsion system. The alarm circuit can also be connected in electrical communication with an ignition or other electrical device associated with an outboard motor in order to deactivate the outboard motor in response to receipt of the signal from the infrared sensor 10. Although not illustrated in the Figures, it should be understood that one or more devices similar to that shown in FIG. 1 can be mounted on the transom of a marine vessel 40 in order to detect a presence of a heat generating object, such as a human being, in the region of an outboard motor. The one or more sensors can be directed to the region proximate the driveshaft housing or gear housing of the outboard motor.

In a preferred embodiment of the present invention, the tube 14 is opaque and has a circular cross section. Also, the infrared detector can be a balanced differential sensor of the series opposed type which is available in commercial quantities from Nippon Ceramic Company. This type of infrared sensor uses two infrared sensing elements that provide signals which can be compared to determine a differential signal between the tube. As a result, movement of a heat generating source within the viewing angle can be detected more easily.

TABLE I

| REFERENCE | TYPE |
|---|---|
| R1 | 560 Ω |
| R2 | 10 kΩ |
| R3 | 10 kΩ |
| R4 | 100 kΩ |
| R5 | 100 kΩ |
| R6 | 100 kΩ |
| R7 | 1 MΩ |
| R8 | 1 MΩ |
| R9 | 10 kΩ |
| R10 | 100 kΩ |
| R11 | 220 Ω |
| C1 | 10 μF |
| C2 | 10 μF |
| C3 | 1 μF |
| C4 | 0.01 μF |

Table I shows the elements of the components in FIG. 6.

Although the present invention has been described with particular specificity and illustrated to show a preferred embodiment, it should be understood that alternative embodiments are also within the scope.

I claim:

1. A safety device for a marine vessel, comprising:

an electrical device;

an infrared sensor having an output signal representing a change in heat intensity within a viewing angle of said infrared sensor;

a tube having a central cavity, said central cavity having a first end and a second end, said infrared sensor being disposed at said first end of said central cavity to receive infrared signals passing along a line of sight defined by said tube in a direction through said central cavity from said second end of said central cavity, said viewing angle of said infrared sensor being defined by a length of said tube and a diameter of said tube, said tube being attached to said marine vessel to direct said line of sight in a generally downward direction toward a surface of water proximate said marine vessel to detect said change in heat intensity in a region proximate said surface of water and proximate said marine vessel; and an alarm circuit connected in signal communication with said infrared sensor and in electrical communication with said electrical device, said alarm circuit being configured to deactivate said electrical device in response to receipt of said output signal from said infrared sensor.

2. The safety device of claim 1, wherein:

the magnitude of said length is at least three times the magnitude of said diameter.

3. The safety device of claim 2, wherein:

the magnitude of said length is four times the magnitude of said diameter.

4. The safety device of claim 1, wherein:

said electrical device is a marine propulsion device.

5. The safety device of claim 1, wherein:

said alarm circuit has an audible alarm output in response to receipt of said output signal from said infrared sensor.

6. The safety device of claim 1, wherein:

said electrical device is an electric motor with a propulsor attached to an output shaft of said electric motor.

7. The safety device of claim 1, wherein:

said tube is opaque.

8. The safety device of claim 1, wherein:

said central cavity is circular in cross section.

9. The safety device of claim 1, wherein:

said infrared sensor comprises two infrared sensing elements in a differential arrangement.

10. A safety device for a marine vessel, comprising:

an electrical marine propulsion device;

an infrared sensor having an output signal representing a change in heat intensity within a viewing angle of said infrared sensor;

a tube having a central cavity, said central cavity having a first end and a second end, said infrared sensor being disposed at said first end of said central cavity to receive infrared signals passing along a line of sight defined by said tube in a direction through said central cavity from said second end of said central cavity, said viewing angle of said infrared sensor being defined by a length of said tube and a diameter of said tube, the magnitude of said length being at least three times the magnitude of said diameter, said tube being attached to said marine vessel to direct said line of sight in a generally downward direction toward a surface of water proximate said marine vessel to detect said change in heat intensity in a region proximate said surface of water and proximate said marine vessel; and an alarm circuit connected in signal communication with said infrared sensor and in electrical communication with said electrical marine propulsion device, said alarm circuit being configured to deactivate said electrical marine propulsion device in response to receipt of said output signal from said infrared sensor.

11. The safety device of claim 10, wherein:

the magnitude of said length is four times the magnitude of said diameter.

12. The safety device of claim 10, wherein:

said alarm circuit has an audible alarm output in response to receipt of said output signal from said infrared sensor.

13. The safety device of claim 12, wherein:

said electrical marine propulsion device is an electric motor with a propulsor attached to an output shaft of said electric motor.

14. The safety device of claim 13, wherein:

said electrical marine propulsion device is an electric motor of a bow thruster.

15. The safety device of claim 10, wherein:

said central cavity is circular in cross section.

16. The safety device of claim 10, wherein:

said infrared sensor comprises two infrared sensing elements in a differential arrangement.

17. A safety device for a marine vessel, comprising:

an electrical marine propulsion device;

an infrared sensor having an output signal representing a change in heat intensity within a viewing angle of said infrared sensor;

a tube having a central cavity, said central cavity having a first end and a second end, said infrared sensor being disposed at said first end of said central cavity to receive infrared signals passing along a line of sight defined by said tube in a direction through said central cavity from said second end of said central cavity, said viewing angle of said infrared sensor being defined by a length of said tube and a diameter of said tube, the magnitude of said length being at least three times the magnitude of said diameter, said tube being attached to said marine vessel to direct said line of sight in a generally downward direction toward a surface of water proximate said marine vessel to detect said change in heat intensity in a region proximate said surface of water and proximate said marine vessel, said central cavity being circular in cross section; and an alarm circuit connected in signal communication with said infrared sensor and in electrical communication with said electrical marine propulsion device, said alarm circuit being configured to deactivate said electrical marine propulsion device in response to receipt of said output signal from said infrared sensor, said alarm circuit having an audible alarm output in response to receipt of said output signal from said infrared sensor.

18. The safety device of claim 17, wherein:

the magnitude of said length is four times the magnitude of said diameter.

19. The safety device of claim 18, wherein:

said electrical marine propulsion device is an electric motor with a propulsor attached to an output shaft of said electric motor.

20. The safety device of claim 19, wherein:

said infrared sensor comprises two infrared sensing elements in a differential arrangement.

* * * * *